US005907216A

United States Patent [19]

Ligthart et al.

[11] Patent Number: 5,907,216

[45] **Date of Patent: *May 25, 1999**

[54] LOW-PRESSURE MERCURY VAPOUR DISCHARGE LAMP

[75] Inventors: Franciscus A.S. Ligthart; Willem J. Van Den Bogert; Johannes T.J. Van Haastrecht, all of Eindhoven; Renate Kaiser, Aachen, all of Germany

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/501,832

[22] Filed: Jul. 13, 1995

[30] Foreign Application Priority Data

Jul. 15, 1994 [EP] European Pat. Off. ..... 94202063

[51] Int. Cl.[6] ..... H01J 61/24

[52] U.S. Cl. ..... 313/564; 313/490; 313/566; 313/552

[58] Field of Search ..... 313/564, 490, 313/565, 566, 552

[56] References Cited

U.S. PATENT DOCUMENTS

| | | | |
|---|---|---|---|
| 2,427,732 | 9/1947 | Mason | 313/566 X |
| 3,227,907 | 1/1966 | Bernier et al. | 313/178 |
| 3,511,405 | 5/1970 | Plagge | 313/552 X |
| 3,629,641 | 12/1971 | Hofmann | 313/229 |
| 3,688,148 | 8/1972 | Fedorenko et al. | 313/552 X |
| 3,784,863 | 1/1974 | Scott | 313/564 |
| 3,983,439 | 9/1976 | Bloomerde et al. | 313/565 X |
| 4,288,715 | 9/1981 | Van Overveld et al. | 313/490 X |
| 4,393,325 | 7/1983 | Van Der Kooi | 313/490 X |
| 4,622,495 | 11/1986 | Smeelen | 315/248 |
| 4,823,047 | 4/1989 | Holmes et al. | 313/565 X |
| 5,294,867 | 3/1994 | Grossman | 313/552 X |

FOREIGN PATENT DOCUMENTS

| | | | |
|---|---|---|---|
| 1086804 | 4/1958 | Germany . | |
| 1274228 | 5/1965 | Germany . | |
| 151212 | 3/1967 | Netherlands | H01J 61/24 |

OTHER PUBLICATIONS

"Amalgamen voor 'TL'–Lampen" by J. Bloem et al, Philips Techn. T, 38, 12–17, 1978/79, No. 1.

*Primary Examiner*—Ashok Patel
*Attorney, Agent, or Firm*—F. Brice Faller

[57] ABSTRACT

A low-pressure mercury vapour discharge lamp according to the invention is provided with a radiation-transmitting discharge vessel (10) which encloses a discharge space (11) in a gastight manner and comprises mercury as well as a rare gas. Mercury is also present in a vapour pressure control member (21) which is in communication with the discharge space (11) during nominal operation. The discharge lamp has means (40) for maintaining a discharge in the discharge space (11). The vapour pressure control member (21) forms part of a mercury control member (20) which also comprises mercury transport control means (22) which limit the mercury transport from the discharge space (11) to the vapour pressure control member (21), at least while the lamp is out of operation, to such an extent that this transport is at most 5 ng/h.cm$^3$, measured at room temperature and in the presence of a saturated mercury vapour in the discharge vessel, per unit volume of the discharge space. The lamp according to the invention has a comparatively high initial radiation output and a comparatively high radiation output at comparatively high lamp temperatures.

5 Claims, 5 Drawing Sheets

LOW-PRESSURE MERCURY VAPOUR DISCHARGE LAMP

BACKGROUND OF THE INVENTION

The invention relates to a low-pressure mercury vapour discharge lamp provided with a radiation-transmitting discharge vessel which encloses a discharge space containing mercury and rare gas in a gastight manner, while also mercury is present in a vapour pressure control member which is in communication with the discharge space during nominal operation, the discharge lamp comprising means for maintaining a discharge in the discharge space.

Such a lamp, referred to as vapour pressure controlled Lamp hereinafter, is known from DE-PS 10 86 804 (1960). The term "nominal operation" in the present description and claims is used for indicating operating conditions under which the mercury vapour pressure is such that the radiation output of the lamp is at least 80% of the output during optimum operation, i.e. under operating conditions where the mercury vapour pressure is ideal. The vapour pressure control member, an amalgam in the known lamp, limits the mercury vapour pressure in the discharge vessel. This renders nominal operation of the lamp possible at comparatively high lamp temperatures such as may occur in the case of a high lamp load, or when the lamp is used in a closed or badly ventilated luminaire.

The mercury vapour pressure at room temperature is comparatively low in the known lamp. The known lamp as a result has the drawback that, when it is operated on a conventional lamp supply, the initial radiation output is also comparatively low, which output is defined here as the radiation output one second after switching-on of the lamp. The run-up period, i.e. the time which the lamp requires for achieving a radiation output of 80% compared with optimum operation, is comparatively long in addition because the vapour pressure rises only slowly after switching-on of the lamp.

A vapour pressure controlled lamp is disclosed in the U.S. Pat. No. 3,227,907 (1966), NL 151 212 (1967), and DE-AS 12 74 228 (1968) in which an electrode ring around an electrode is provided with an auxiliary amalgam in addition to a main amalgam which acts as a vapour pressure control member. Provided the auxiliary amalgam contains sufficient mercury, the lamp will have a comparatively short run-up period. Upon switching-on of the lamp, in fact, the auxiliary amalgam is heated by the electrode, so that it evolves a substantial portion of the mercury present therein comparatively quickly. A condition is that the lamp must have been out of operation sufficiently long before switching-on, so that the auxiliary amalgam has been able to take up sufficient mercury. If the lamp has been out of operation for a comparatively short period, the shortening effect on the run-up period is only weak. In addition, the initial radiation output is even lower then compared with that of a lamp with a main amalgam only because the auxiliary amalgam continues drawing mercury vapour from the discharge space up to the moment of switching-on of the lamp, thus keeping the vapour pressure low. Furthermore, the drawback arises in comparatively long lamps that comparatively much time is required before the mercury evolved by the auxiliary amalgam has spread over the entire discharge vessel, so that such lamps show a comparatively bright zone near the auxiliary amalgam and a comparatively dark zone remote from the auxiliary amalgam for a few minutes after switching-on.

In vapour pressure controlled lamps with an auxiliary amalgam, the quantity of mercury contained in the auxiliary amalgam depends on the quantity of auxiliary amalgam and the time the lamp has been out of operation, called off-time hereinafter. When the auxiliary amalgam in a lamp has a comparatively great mass, the auxiliary amalgam contains so much mercury after a long off-time that a renewed switching-on of the lamp evolves an excess quantity of mercury in the discharge space. It takes a few tens of minutes then before the main amalgam has absorbed this excess quantity. During this time, the mercury vapour pressure is too high and the lamp accordingly has a comparatively low radiation output. When the auxiliary amalgam in a lamp has a comparatively small mass, the auxiliary amalgam on the contrary contains too little mercury after a short off-time for compensating the absorption by the main amalgam during the first tens of minutes after switching-on. This leads to the effect that the mercury vapour pressure rises initially, then falls, and does not rise again until the main amalgam has also assumed its operational temperature. To counteract this effect, U.S. Pat. No. 3,629,641 (1971) proposes the use of a second auxiliary amalgam which is further removed from the electrode and which takes over the role of the first auxiliary amalgam when the latter is incapable of supplying any more mercury.

After switching-off of the lamp, however, it takes a long time before the auxiliary amalgam(s) has (have) absorbed the necessary quantity of mercury again. When this lamp is switched on before that time, the lamp has a long run-up period in spite of the presence of the auxiliary amalgam.

SUMMARY OF THE INVENTION

The publication "Amalgamen voor 'TL'-lampen" (Amalgams for 'TL' lamps) by J. Bloem, A. Bouwknegt and G. A. Wesselink, Philips Techn. T., vol. 38, 1978/79, pp. 12–17, suggests a solution to this problem through the use of a main amalgam which has a comparatively high vapour pressure at room temperature. Even then, however, the initial radiation output of the lamp is still comparatively low. En addition, a comparatively high vapour pressure at low temperature is usually accompanied by a less wide temperature interval within which nominal operation is possible.

The use of an auxiliary amalgam in an electrodeless lamp is known from U.S. Pat. No. 4,622,495 (1986).

Besides the amalgam lamps described above there are low-pressure mercury vapour discharge lamps which are not provided with a vapour pressure control member and which contain free mercury only. These lamps, referred to as mercury lamps hereinafter, have the advantage that the vapour pressure at room temperature, and thus the initial radiation output, is comparatively high. Moreover, the run-up period is comparatively short. Also comparatively long lamps of this type have a substantially constant brightness over substantially their entire length after switching-on because after switching-off of the lamp the mercury released from the vapour phase condenses comparatively evenly spread over the internal surface of the discharge vessel. Upon a renewed switching-on of the lamp, mercury vapour is evolved again over the entire length of the discharge vessel. Nominal operation at comparatively high lamp temperatures can be achieved with a mercury lamp whose discharge space contains just enough mercury for achieving a vapour pressure close to the optimum vapour pressure at the operating temperature. During lamp life, however, mercury is lost because it is bound, for example, to the wall and to emitter material. Such a lamp as a result has only a limited life in practice. Therefore, a quantity of mercury is dosed into practical mercury lamps which is considerably greater than the quantity which is required in the vapour phase during nominal operation. This has the disadvantage, however, that the vapour pressure is equal to the vapour saturation pressure belonging to the temperature of the coldest spot in the discharge vessel. Since the vapour saturation pressure rises exponentially with the temperature, temperature variations will lead to comparatively strong variations in the luminous efficacy of the lamp. High temperatures which occur, for example, in a badly ventilated luminaire or in the case of a high lamp load lead to a strong reduction in the radiation output in such lamps.

It is an object of the invention to provide a lamp of the kind described in the opening paragraph which, at least in regular use, has a comparatively high initial radiation output, a short run-up period, and also a comparatively high radiation output at comparatively high lamp temperatures.

According to the invention, a lamp of the kind described in the opening paragraph is for this purpose characterized in that the vapour pressure control member forms part of a mercury control member which also comprises mercury transport control means which limit the mercury transport from the discharge space to the vapour pressure control member, at least while the Lamp is out of operation, such that this transport amounts to at most 5 ng/h.cm$^3$ per unit volume of the discharge space when measured at room temperature and in the presence of a saturated mercury vapour in the discharge space.

Since the mercury transport control means limit the mercury transport to the vapour pressure control member during the period the lamp is out of operation, referred to as off-state hereinafter, sufficient mercury remains in the discharge space for facilitating an initial radiation output upon lamp ignition which is comparatively high against that of a lamp in which mercury transport control means are absent. Although the lamp according to the invention is a vapour pressure controlled lamp, the lamp has a comparatively short run-up period without additional measures such as an auxiliary amalgam being necessary. The lamp has a comparatively high radiation output at comparatively high lamp temperatures because the vapour pressure control member is in communication with the discharge space during operation.

The mercury transport may be measured as follows. A tube is fused to the discharge vessel so as to be in communication therewith. Then an end of the tube is cooled down so that free mercury present in the discharge space condenses at said end. The condensed mercury is subsequently removed and replaced by the radioactive tracer mercury $^{203}$Hg. Then the speed with which the tracer mercury is taken up in the vapour pressure control member is measured with a gamma detector.

The discharge vessel may be provided with a luminescent layer on an internal surface. The luminescent layer comprises, for example, the luminescent materials barium-magnesium aluminate activated by bivalent europium (BAM), cerium-magnesium aluminate activated by trivalent terbium (CAT), and yttrium oxide activated by trivalent europium (YOX). The lamp is suitable then for general lighting purposes. In another embodiment the luminescent layer comprises lead-activated barium silicate (BSP). Such a lamp is used as a sun couch lamp, Alternatively, for example in a lamp for disinfection purposes, a luminescent layer may be absent.

In an attractive embodiment, the mercury transport is below 0.5 ng/h.cm$^3$ This lamp has a comparatively high initial radiation output also when it has been out of operation during a prolonged period, for example during storage in a storehouse.

In tubular low-pressure mercury vapour discharge lamps, the mercury vapour pressure required for optimum operation is higher, and accordingly the initial radiation output is lower in proportion as the effective internal diameter of the discharge vessel is smaller. By effective internal diameter is meant in the present description and claims the circumference along the internal surface of the lamp divided by $\pi$. The effective internal diameter is equal to the internal diameter in a discharge vessel having a circular cross-section. It was found in practice for mercury lamps in which a vapour pressure control member is absent that the initial radiation output is approximately $100*(1-e^{-D/15})\%$ of the radiation output during optimum operation, where D is the effective internal diameter in mm of the discharge vessel. In proportion as the effective diameter of the discharge vessel is smaller in vapour pressure controlled lamps, not only the initial radiation output is lower, but in addition the effect of a vapour pressure drop on the initial radiation output is greater as a result of a vapour pressure control member which is in unhampered communication with the discharge space.

A low-pressure mercury vapour discharge lamp provided with a radiation-transmitting tubular discharge vessel having an effective internal diameter of D mm and enclosing a discharge space which contains mercury and rare gas in a gastight manner, while also mercury is present in a vapour pressure control member which is in communication with the discharge space during nominal operation, a pair of electrodes being arranged in the discharge space and current supply conductors issuing from the pair of electrodes to outside the discharge vessel, is characterized in that according to the invention the vapour pressure control member forms part of a mercury control member which also comprises mercury transport control means which, at least while the lamp is not operational, limit the reabsorption of mercury by the vapour pressure control member such that lamp after having burned in nominal operation during 4 hours and having been out of operation subsequently for 16 hours has an initial radiation output at room temperature which is at leas $70*(1-e^{-D/15})\%$ of the radiation output during optimum operation.

In a lamp according to the invention in which mercury transport control means are present between the discharge space and the vapour pressure control member, an initial radiation output is realised which is at least 70% of the output obtained in a mercury lamp of the same effective internal diameter in spite of the presence of the vapour pressure control member.

The vapour pressure control member is accommodated, for example, in the exhaust tube while a constriction is provided in a portion of the exhaust tube between the vapour pressure control member and the discharge space, which constriction forms mercury transport control means. The vapour pressure control member and the construction in the exhaust tube then together form a mercury control member. Preferably, the mercury control member is a separate component. This has the advantage that only slight adaptations in the existing production process are necessary for manufacturing the lamp according to the invention.

An embodiment of a low-pressure mercury vapour discharge lamp provided with a radiation-transmitting discharge vessel which encloses a discharge space in a gastight manner, this containing mercury and rare gas and having a volume V, while also mercury is present in a vapour pressure control member which is in communication with the discharge space during nominal operation and the discharge lamp comprises means for maintaining a discharge in the discharge space, is characterized in that according to the invention the vapour pressure control member is accommodated in a holder and communicates with the discharge space through an opening having a surface area A in the holder, while the ratio A/V is at most $2.5\times10^{-6}$ $m^{-1}$. The holder containing the vapour pressure control member may be positioned in the same location in the lamp during lamp manufacture where the vapour pressure control member is positioned in the known lamps. The holder is, for example, a glass capsule in which the opening has been provided by means of a laser beam.

An attractive modification of this embodiment is characterized in that the ratio A/V is at most $2.5\times10^{-7}$ $m^{-1}$. The lamp then has a comparatively high initial radiation output also after a comparatively long off-time.

An embodiment of a low-pressure mercury vapour discharge lamp provided with a radiation-transmitting discharge vessel which encloses a discharge space containing mercury and rare gas in a gastight manner, while also mercury is present in a vapour pressure control member which is in communication with the discharge space during nominal operation and the discharge lamp comprises means for maintaining a discharge in the discharge space, is characterized in that according to the invention the vapour pressure control member is enclosed by a holder which has at least one porous portion, through which porous portion the vapour pressure control member is in communication with the discharge space.

In an embodiment, the entire holder is made of a porous material, for example of a ceramic material which has been sintered around the vapour pressure control member.

In a favourable embodiment, the holder comprises besides the porous portion a gastight portion, the porous portion enclosing the vapour pressure control member in a cavity of the gastight portion. This has the advantage that the porous portion can already be manufactured before it is assembled together with the vapour pressure control member, which simplifies the manufacture of the mercury control member.

An attractive modification of the above embodiment, in which the discharge space has a volume V, is characterized in that the porous portion has a length L in a direction from inside to outside the cavity and has a surface area A transverse to said direction, while the porous portion is made of a material having a porosity $\epsilon$ and a tortuosity $\beta$ such that $(\epsilon/\beta^2).(A/(L.V))$ is at most $25\times10^{-3}$ $m^{-1}$. The tortuosity $\beta$ is understood to mean the average ratio between the length of the channels formed in the porous material and the distance between the beginning and the end of the channels. In practical porous materials, for example ceramic materials, the tortuosity lies between 5 and 10. The porosity may be chosen within a comparatively wide interval, which affords a high degree of design freedom as to the dimensions of the holder. The holder has, for example, a gastight portion made of quartz glass into which a porous portion of aluminium oxide has been fused.

The vapour pressure control member may be, for example, a zeolite. Preferred is, however, a lamp according to the invention in which the vapour pressure control member is an amalgam. The use of an amalgam has the advantage that not only the mercury vapour pressure at high temperatures is limited, but also nominal lamp operation is possible in a comparatively wide temperature range. In an embodiment, the amalgam is provided with an oxide layer. The oxide layer is, for example, comparatively thin so that mercury diffusion through the layer is possible, the oxide layer forming the mercury transport control means. Alternatively, the oxide layer may be comparatively thick, the mercury transport control means being formed by an interruption in the oxide layer.

Comparatively much mercury can be bound to the wall during operation at the beginning of the life of a low-pressure mercury vapour discharge lamp. To avoid this, the discharge vessel of a lamp according to the invention may have a protective layer of a metal oxide at an internal surface. Such a protective layer, for example, of scandium oxide, yttrium oxide, lanthanum oxide, or an oxide of one of the lanthanides, counteracts the loss of mercury caused by binding to the wall. It is favourable when the vapour pressure control member can supply comparatively much mercury during operation to compensate losses. Additional measures for realising a sufficiently high mercury vapour pressure also at the beginning of lamp life are unnecessary then.

A low-pressure mercury vapour discharge lamp provided with a radiation-transmitting discharge vessel which encloses a discharge space containing mercury and rare gas in a gastight manner, while also mercury is present in an amalgam which is in communication with the discharge space during nominal operation, the discharge lamp having means for maintaining a discharge in the discharge space, is characterized in that according to the invention the amalgam is in communication with the discharge space through a capillary, amalgam extending to inside the capillary. The capillary has, for example, a diameter of a few $\mu$m for a comparatively short capillary up to a few hundred $\mu$m for a comparatively long capillary.

When the lamp is not in operation, the amalgam is at least substantially in the solid phase, that diffusion of mercury through the amalgam in the capillary substantially does not take place,, During lamp operation, the amalgam is to a substantial degree in the liquid phase. Mercury can then diffuse through the amalgam comparatively easily. It is thus achieved in a simple manner that the vapour pressure control member hardly takes up mercury from the discharge space when the lamp is not operating, whereas a substantially unhampered mercury transport can take place during lamp operation. Mercury losses during operation are thus compensated.

In a practical modification of this embodiment, the amalgam is accommodated in a glass vessel of which a narrowed end forms the capillary. The glass vessel with the amalgam may be manufactured in that a tube provided with a capillary at one end is filled with an amalgam, after which the amalgam in the liquid state is pressed into the capillary through the application of an overpressure with an inert gas at the opposed end of the tube. Then the tube is fused in a portion opposite the capillary beyond the amalgam. The remaining portion of the tube, which is connected to the vessel via the fused portion, may serve as a fastening means, for example, for fastening the vessel to a wall portion of the discharge vessel. Alternatively, the vessel may be accommodated, for example, in an exhaust tube of the lamp after it has been detached from the remaining portion of the tube.

In an advantageous modified embodiment, the amalgam is present in a cavity of a first part of a holder, which holder also has a second part which is enclosed with narrow fit in a portion of the cavity not occupied by the amalgam, while the capillary, which is present, for example, in the second part, affords access to the cavity from outside the holder. The holder is very easy to assemble. The amalgam is provided in the cavity of the first part. With the amalgam in the molten state, the second part is then pressed into the cavity of the first part until the amalgam has substantially penetrated into the capillary. The parts of the holder are made, for example, of metal, for example of stainless steel. Alternatively, the parts may be manufactured from a heat-resistant synthetic resin. The cavity in the first pat and the second part enclosed therein have, for example, a cylindrical cross-section. In another embodiment, the cavity and the second part enclosed therein widen conically towards the outside. Assembling the holder has been further simplified thereby.

BRIEF DESCRIPTION OF THE DRAWINGS

These and other aspects of the lamp according to the invention will be explained in more detail with reference to the drawings, in which.

DESCRIPTION OF PREFERRED EMBODIMENTS

Figure 1:
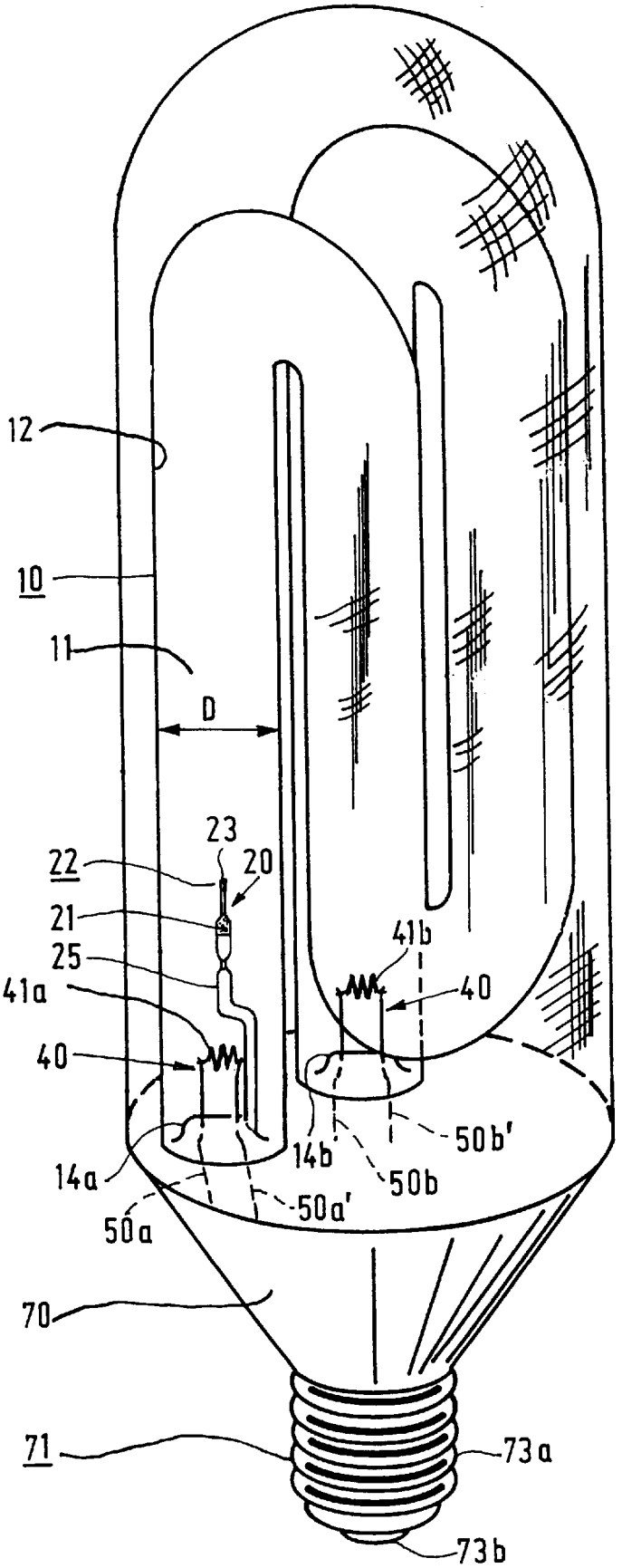
FIG. 1 shows a first embodiment of the lamp according to the invention in elevation.

FIG. 1 shows a low-pressure mercury vapour discharge lamp which is provided with a radiation-transmitting discharge vessel 10 which encloses a discharge space 11 with a volume V of 30 $cm^3$ in a gastight manner. The discharge vessel 10 is a lime-glass tube with a circular cross-section having an (effective) internal diameter D of 10 mm. The tube has been bent into a hook shape. The discharge vessel 10 is provided at an internal surface 12 with a luminescent layer (not shown) which comprises the luminescent materials BAM, CAT, and YOX. The discharge vessel 10 is supported by a housing 70 which also supports a lamp cap 71. The discharge space 11 comprises besides mercury also a rare gas, here argon. Mercury is present not only in the discharge space 11 but also in a vapour pressure control member 21, here an amalgam, in the embodiment shown consisting of 50 mg of an amalgam of 3% by weight Kg with an alloy of Bi and In in a weight ratio 67:33. Means 40 for maintaining a discharge are formed by a pair of electrodes 41*a,* 41*b* arranged S in the discharge space 11. The pair of electrodes 41*a,* 41*b* comprises a first and a second electrode, each supported by an indented portion 14*a,* 14*b* of the discharge vessel 10. Current supply conductors 50*a,* 50*a*'; 50*b,* 50*b*' issue from the electrode pair 41*a,* 41*b* through the indented portions 14*a,* 14*b* of the discharge vessel 10 to the exterior. The current supply conductors 50*a,* 50*a*' 50*b,* 50*b*' are connected to a supply (not shown) which is accommodated in the housing 70 and is electrically connected to contacts 73*a,* 73*b* at the lamp cap 71.

The vapour pressure control member 21 (shown in more detail in FIG. 2) forms part of a mercury control member 20 which also comprises mercury transport control means 22.

In the embodiment shown, the amalgam 21 is in communication with the discharge space 11 through a capillary 23, amalgam 21*a* extending into the capillary 23 and filling a cross-section of the capillary. The capillary 23 provided with amalgam 21*a* in this case forms the mercury transport control means 22. In the embodiment shown, the amalgam 21 is enclosed in a glass vessel 24 of which a narrowed end 23 forms the capillary. The capillary 23 has an internal diameter of 200 $\mu$m and a length of 10 mm. The vessel 24 is integral with a tube 25 which has been fused to one of the indented portions 14*a* of the discharge vessel 10.

Figure 2:
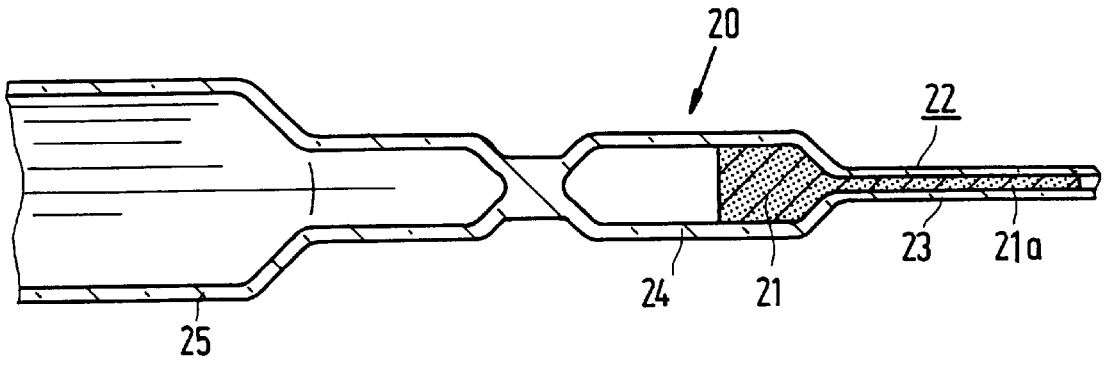
FIG. 2 shows a component of the lamp of FIG. 1 in more detail in longitudinal section.
Figure 3:
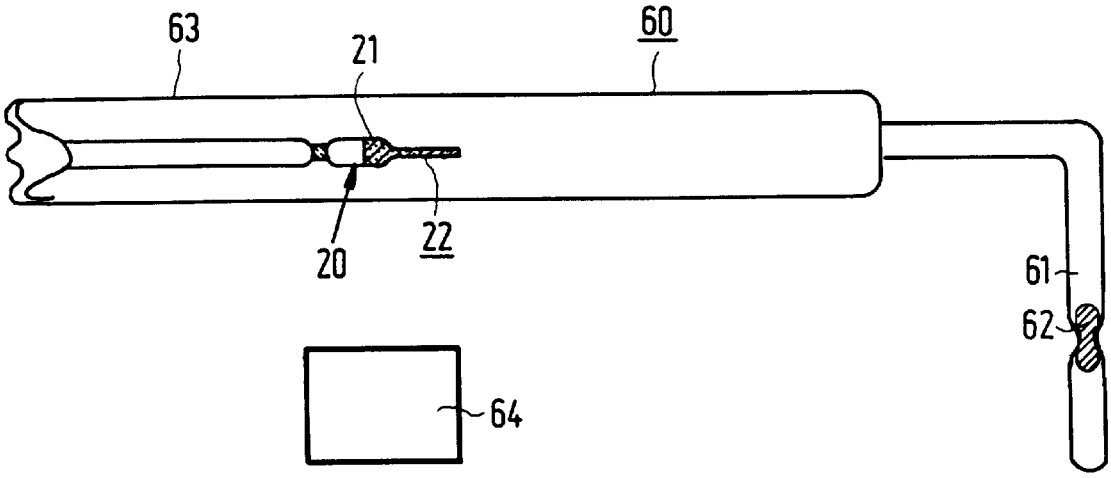
FIG. 3 shows an arrangement for measuring the reabsorption of mercury by the vapour pressure control member in elevation.

Two arrangements (I, II) each for three amalgam types were manufacturer as shown in FIG. 3 for measuring the reabsorption of mercury by the vapour pressure control member with the lamp in the off-state. Reference numeral 60 here denotes a closed glass tube with a comparatively narrow end 61 in which an open mercury capsule 62 containing the radioactive tracer mercury $^{203}$Hg is accommodated. In an opposite end 63 of the tube 60, a mercury control member 20 as shown in FIG. 2 is positioned. The quantity of tracer mercury absorbed in the amalgam 21 was measured by means of a T-spectrometer 64. It was investigated not only for the amalgam Bi67In33+3% Hg by 30 weight mentioned above but also for the amalgam Pb20Bi46Sn34+3% Hg by weight and Pb20In40Sn40+3% Hg by weight to what extent they absorb mercury from an atmosphere saturated with mercury vapour in an arrangement as shown in FIG. 3. The numbers after each element indicate the proportional weight of that element in the alloy with which the amalgam is formed. The speed with which mercury was absorbed in the amalgam is given in ng/h in the following Table.

| | mercury transport (ng/h) | |
|---|---|---|
| Amalgam | I | II |
| Bi67 In33 + 3% Hg by weight | 0.064 | 0.073 |
| Pb20 Bi46 Sn34 + 3% Hg by weight | 0.073 | 94 |
| Pb20 In40 Sn40 + 3% Hg by weight | 0.049 | 0.049 |

The mercury transport in the mercury control members with the BiIn amalgam is 0.064 and 0.073 ng/h, respectively. When used in an embodiment of the lamp as shown, where the discharge space has a volume of 30 $cm^3$, the mercury transport per unit volume is accordingly 0.021 and 0.0024 ng/h.$cm^3$, respectively. The mercury transport is thus below the upper limit mentioned of 5 ng/h.$cM^3$. The other mercury control members also meet this requirement when used in the embodiment of the lamp shown. With one exception, the PbBiSn amalgam in arrangement 11, the mercury transport per unit volume in the mercury control members used in the embodiment of the lamp shown is even substantially below 0.5 ng/h.$cm^3$.

It is assumed that, with the PbBiSn amalgam in arrangement II, there is a space between the capillary and the amalgam over a portion of the length of the capillary, whereby a comparatively large surface area of the amalgam is in contact with the atmosphere of the discharge space. This effect can be avoided through the use of an amalgam containing indium. The presence of this metal in the amalgam promotes wetting and adhesion of the amalgam to the glass. Alternatively, for example, a holder with a metal capillary may be used. A good adhesion to the amalgam is also obtained then.

Further measurements have shown that the mercury transport through the amalgam in the capillary takes place more quickly by a factor 1 to 1000 with the lamp in the operating state, when the amalgam is in the liquid state, compared with the off-state.

Figure 4:
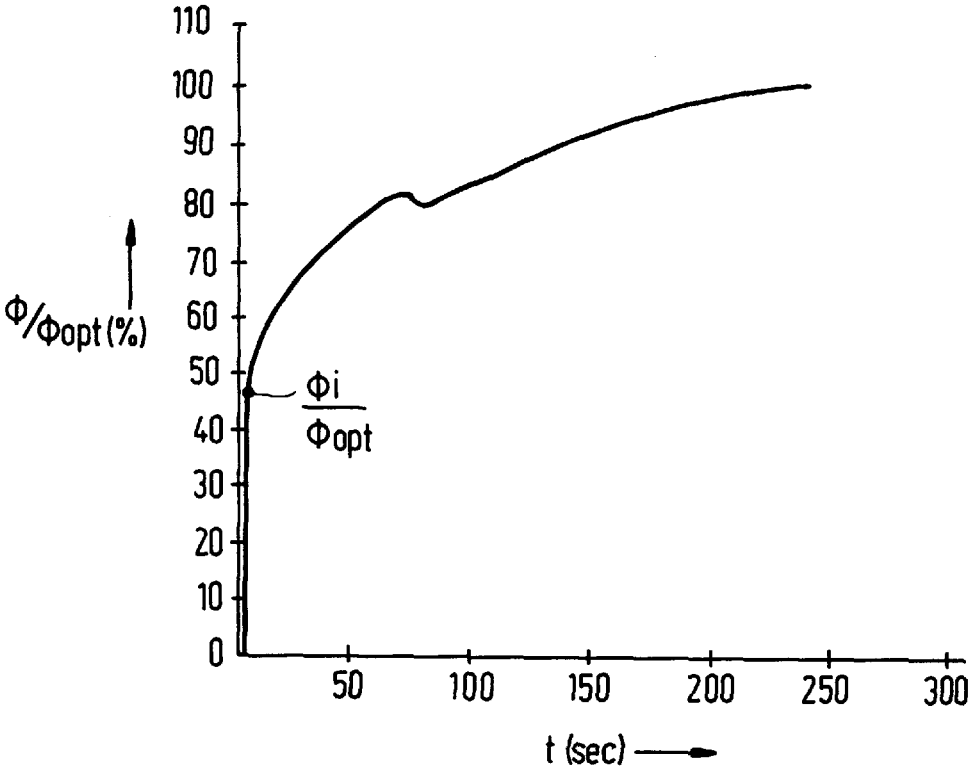
FIG. 4 shows the radiation output of the lamp as a function of the time which has elapsed after switching-on of the lamp.

To determine the initial radiation output $\Phi_i$, the lamp shown in FIG. 1 was operated for 4 hours and then switched off for 16 hours. The radiation output $\Phi$ as a function of the time after renewed switching-on of the lamp is shown in FIG. 4 as a percentage of the radiation output during optimum operation $\Phi_{opt}$. The initial radiation output $\Phi_i$ measured after 1 s was 43% of the value during optimum operation. The initial radiation output $\Phi_i$ is thus greater than $70*(1-e^{-10/15})$%, i.e. 34%. The run-up period was 60 s. This is much shorter than the run-up period in conventional amalgam lamps without auxiliary amalgam. The lamp was operated at a constant current of 200 mA and a frequency of 45 kHz in this and the subsequent measurements.

Figure 5:
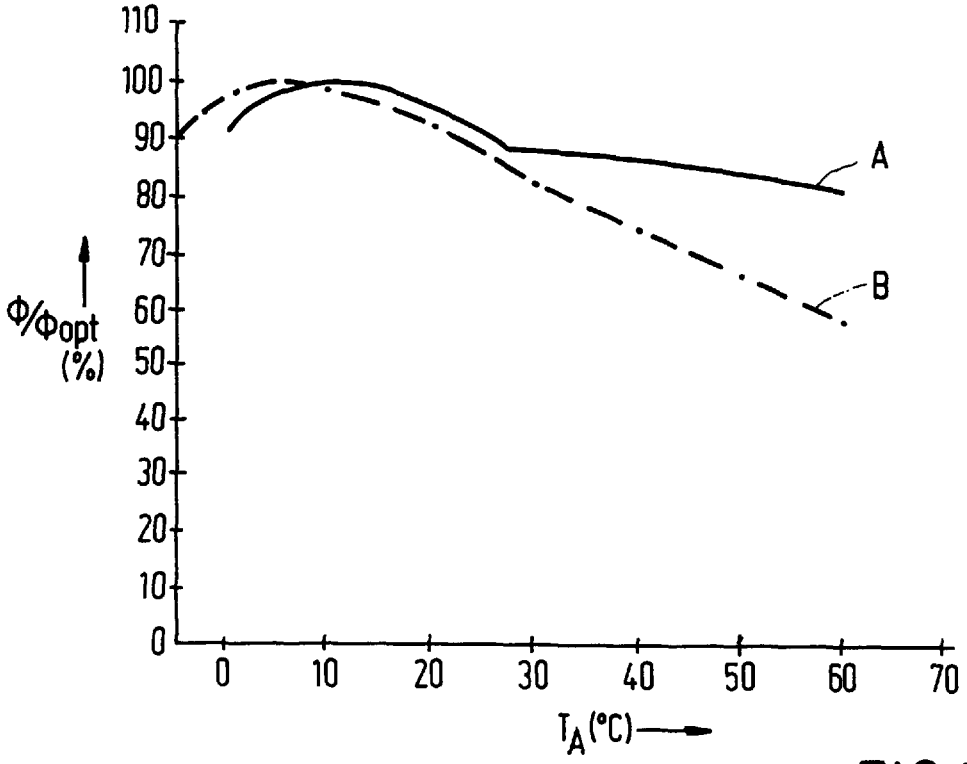
FIG. 5 shows the radiation output of the lamp is a function of ambient temperature.

In a further investigation, the effect of the ambient temperature $T_A$ on the radiation output $\Phi$ was measured. The ambient temperature $T_A$ was for this purpose varied between 0 and 60° C. Curve A in FIG. 5 indicates the results of this measurement. The radiation output is given therein as a percentage of the radiation output $\Phi_{opt}$ during optimum operation. For comparison, curve B shows the radiation output of a lamp not according to the invention which contains exclusively free mercury in the discharge vessel. It is apparent from the measurements that the radiation output of the lamp according to the invention depends on the temperature to a much lesser degree than that of the lamp not according to the invention, and that the temperature range for nominal operation is much wider.

Figure 6:
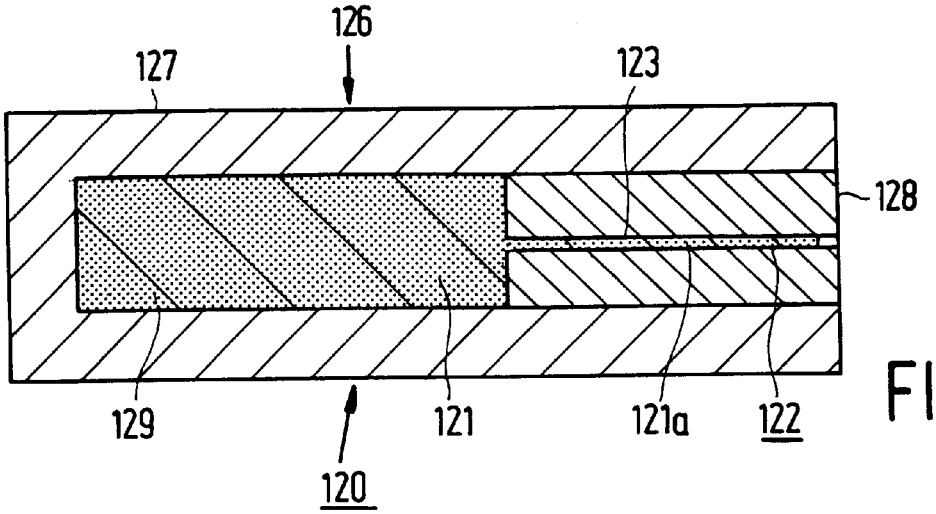
FIG. 6 shows a second embodiment of the component of FIG. 2.

A second embodiment of the mercury control member is shown in FIG. 6. Components in this Figure corresponding to those in FIG. 2 have reference numerals which are 100 higher. In this embodiment, the amalgam 121 is present in a cavity 129 of a first portion 127 of a holder 126. The cavity 129 has an internal diameter of 1.56 mm and is filled with amalgam to a depth of 6.8 mm. The holder 126 in addition comprises a second part 128 which is 4 mm long and is enclosed with narrow fit in a portion of the cavity 129 not occupied by the amalgam 121. A capillary 123 with an internal diameter of 172 $\mu$m in the second portion 128 provides access to the interior of the cavity 129 from outside the holder 126. The amalgam 121 extends into the capillary 123. In an alternative embodiment, the capillary is present, for example, in the first part, or the capillary is formed, for example, by a groove in one of the parts in a surface which is in contact with the other part.

The holder is positioned, for example, in an exhaust tube of the lamp. Alternatively, the holder may be fastened, for example, to a rod which has been fused to the wall of the discharge vessel.

Figure 7:
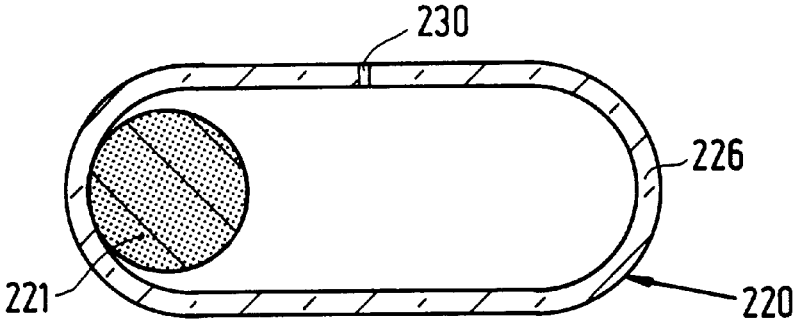
FIG. 7 shows a third embodiment of the component of FIG. 2.

FIG. 7 shows a third embodiment of the mercury control member 220. In this Figure, components corresponding to those of FIG. 2 have reference numerals which are 200 higher. In this embodiment, the vapour pressure control member 221 is enclosed in a holder 226 formed by a glass capsule. The vapour pressure control member 221 is in communication with the discharge space 11 through the opening 230 with a surface area A of 2 $\mu m^2$. The ratio A/V for a lamp according to FIG. 1 with a volume of 30 $cm^3$ is $6.7\times10^{-8}$ $m^{-1}$, which is smaller than said $2.5\times10^{-6}$ $m^{-1}$ and moreover smaller than $2.5\times10^{-7}$ $m^{-1}$.

Figure 8:
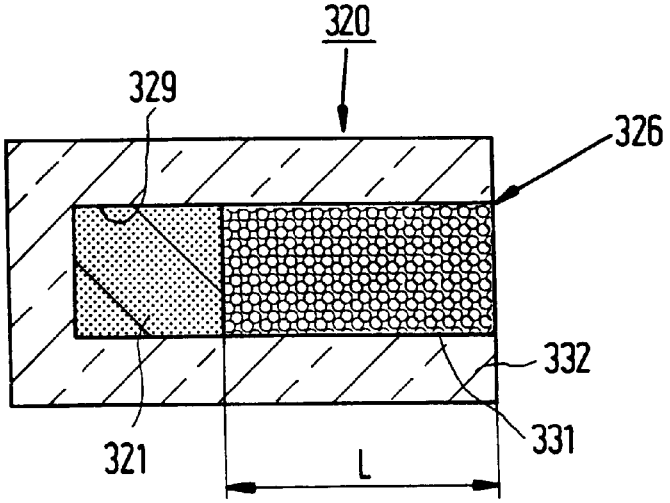
FIG. 8 shows a fourth embodiment of the component of FIG. 2.

A fourth embodiment of the mercury control member 320 is shown in FIG. 8. Components therein corresponding to those of FIG. 2 have reference numerals which are 303 higher. In is embodiment, the vapour pressure control member 321 is enclosed by a holder 326 with at least one porous portion 331 through which the vapour pressure control member 321 is in communication with the discharge space 11. In the embodiment shown, the holder 326 comprises besides the porous portion 331 a gastight portion 332. The porous portion 331 encloses the vapour pressure control member 321 in a cavity 329 in the gastight portion 332. The porous portion 331 is a ceramic cylinder which has a length L of 10 mm seen in a direction from inside to outside the cavity, and a surface area A of 3.14 $mm^2$ seen in a direction transverse thereto. The ceramic material, here aluminium oxide, has a porosity $\epsilon$ of 0.002 and a tortuosity $\beta$ of 5. The value of $(\epsilon/(\beta^2)).(A/(L.V))$ is thus 0.0084 $m^{-2}$, which is below 0.025 $m^{-2}$, for a lamp according to FIG. 1.

Figure 9:
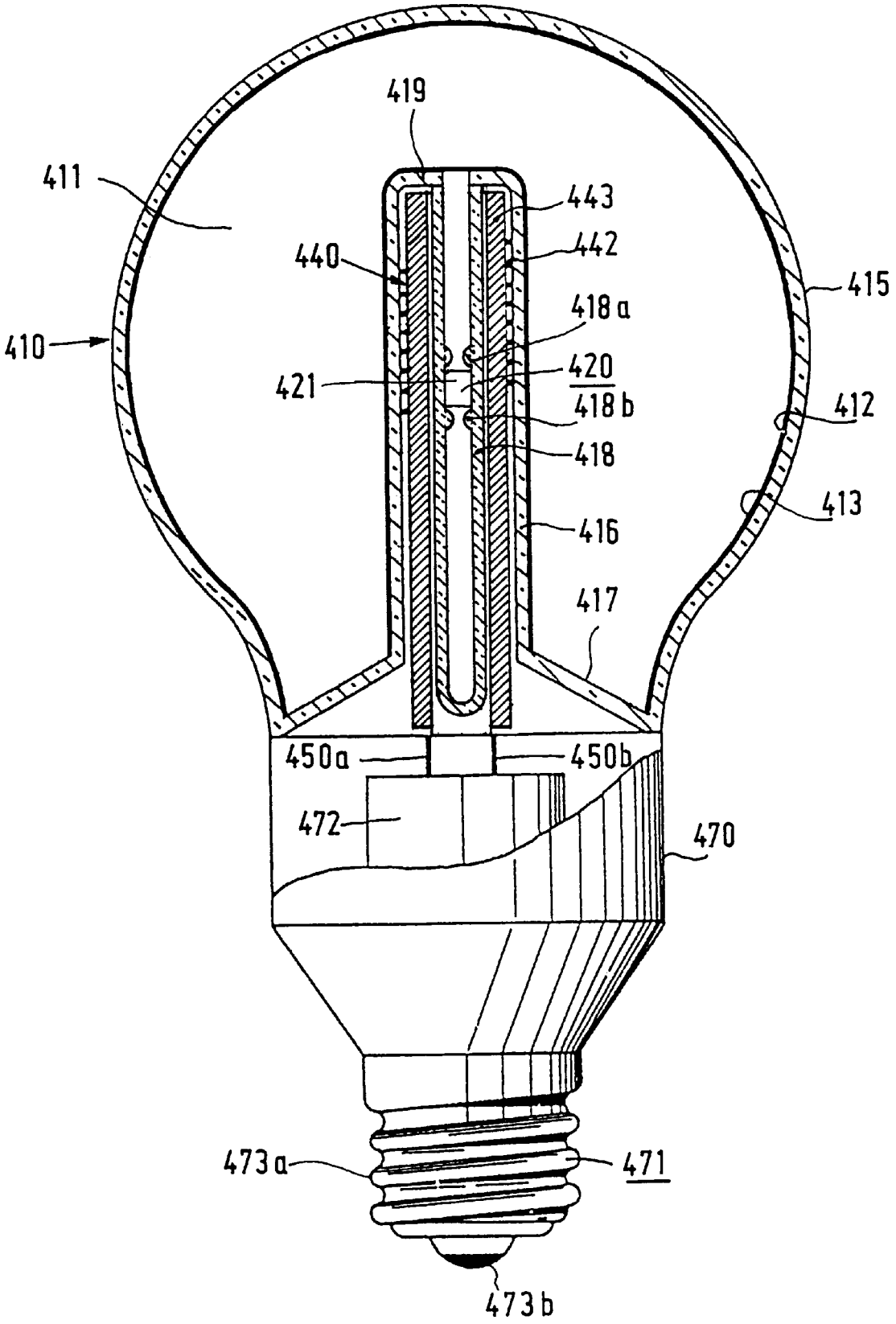
FIG. 9 shows a second embodiment of the lamp according to the invention, partly in elevation, partly in longitudinal section.

An alternative embodiment of the lamp according to the invention is shown in FIG. 9. Components in this Figure corresponding to those of FIG. 1 have reference numerals which are 400 higher. The lamp shown in FIG. 7 has a glass discharge vessel 410 with a pear-shape enveloping portion 415 and a tubular invaginated portion 416 which is connected to the enveloping portion 415 via a flared collar portion 417. The discharge vessel 410 is provided with a luminescent layer 413 at an internal surface 412. The discharge vessel 410 is supported by a housing 470 which also supports a lamp cap 471. Centrally positioned in the invaginated portion 416 is an exhaust tube 418 which is in connection with the discharge space 411 at an end 419 which faces away from the flared collar portion 417. The discharge space 411 contains mercury and a rare gas, for example argon. Mercury is also present in a vapour pressure control member 421 which forms part of a mercury control member 420 which is arranged in the exhaust tube 418 between a first and a second ridge 418*a*, 418*b*. The mercury control member 420 is an embodiment, for example, as shown in FIGS. 2, 6, 7, or 8. Means 440 for maintaining a discharge are formed by a coil 442 which is accommodated in the invaginated portion 416 of the discharge vessel 410 around the exhaust tube 418. The coil 442 is connected via current supply conductors 450*a*, 450*b* to a supply 472 which is accommodated in the housing 470 and is connected to contacts 473*a*, 473*b* at the lamp cap 471. In the embodiment shown, the coil 442 is provided around a core 443 of soft-magnetic material. In alternative embodiment, no core is present. In yet another embodiment, the coil is positioned in the discharge space.

What is claimed is:

1. A low-pressure vapor discharge lamp comprising:

a radiation-transmitting discharge vessel which encloses a discharge space containing mercury and rare gas in a gastight manner;

means for maintaining a discharge in the discharge space; and a mercury control member which comprises an amalgam which is in communication with the discharge space during nominal operation and mercury transport control means for limiting mercury transport from the discharge space to the amalgam, at least while the lamp is out of operation, to at most 5 ng/h.$cm^3$ per unit volume of the discharge space when measured at room temperature and in the presence of a saturated mercury vapor in the discharge space.

2. A low-pressure mercury vapor discharge lamp as claimed in claim 1, characterized in that the mercury transport is at most 0.5 ng/h.cm$^3$.

3. A low-pressure mercury vapor discharge lamp comprising:

a radiation-transmitting tubular discharge vessel having an effective internal diameter of D mm and enclosing a discharge space which contains mercury and rare gas in a gastight manner;

a pair of electrodes being arranged in the discharge space;

current supply conductors issuing from the pair of electrodes to outside the discharge vessel; and a mercury control member which comprises an amalgam which in communication with the discharge space during-nominal operation and mercury transport control means which, at least while the lamp is not operational, for limiting reabsorption mercury by the amalgam such that the lamp after having burned in nominal operation during hours and having been out of operation subsequently for 16 hours has an initial radiation output at room temperature which is at least $70*(1-e^{-1D/15})\%$ of the radiation output during optimum operation.

4. A low pressure mercury vapour discharge lamp comprising a radiation transmitting discharge vessel enclosing a gastight discharge space containing mercury and an inert gas, means for maintaining a discharge in the discharge space, and an amalgam which is in communication with the discharge space through a capillary, said amalgam extending to inside the capillary and filling a cross-section of the capillary.

5. A low pressure mercury vapour discharge lamp as in claim 4, wherein said amalgam is accommodated in a glass vessel having a narrowed end forming said capillary and filling a cross-section of the capillary.

* * * * *

UNITED STATES PATENT AND TRADEMARK OFFICE

CERTIFICATE OF CORRECTION

PATENT NO. : 5,907,216 
DATED : May 25, 1999
INVENTOR(S) : Franciscus A.S. Ligthart, Willem J. Van Den Bogert, Johannes T.J. Van Haastrecht and Renate Kaiser It is certified that error appears in the above-identified patent and that said Letters Patent is hereby corrected as shown below:

Column 11,
Line 18, after "reabsorption" insert -- of --.
Line 20, after "during" insert -- 4 --.

Column 12,
Line 19, delete "and".
Line 20, delete "filling a cross-section of the capillary".

Signed and Sealed this

Twenty-ninth Day of October, 2002

*Attest:*

*Attesting Officer*

JAMES E. ROGAN
*Director of the United States Patent and Trademark Office*